US005712446A

United States Patent [19]

Spence

[11] Patent Number: 5,712,446

[45] Date of Patent: Jan. 27, 1998

[54] FLAT-SIDED MODEL ROCKET AND METHOD THEREFOR

[76] Inventor: David R. Spence, 3970 N. Hwy. 89, Prescott, Ariz. 86301

[21] Appl. No.: 581,785

[22] Filed: Jan. 2, 1996

[51] Int. Cl.[6] ..... F42B 4/08; A63H 27/00

[52] U.S. Cl. ..... 102/348; 102/351; 102/354; 102/355; 244/189; 446/231; 446/56; 446/125

[58] Field of Search ..... 102/348, 351, 102/354, 355; 446/231, 125, 56; 244/189

[56] References Cited

U.S. PATENT DOCUMENTS

| | | | |
|---|---|---|---|
| 274,067 | 3/1883 | Weeks | 102/347 |
| 1,667,180 | 4/1928 | Willson | 102/351 X |
| 2,344,957 | 3/1944 | Anzalone | 102/347 |
| 3,292,302 | 12/1966 | Estes et al. | 102/347 |
| 3,820,275 | 6/1974 | Green | 102/347 X |
| 3,888,178 | 6/1975 | Senoski | 244/13 |
| 3,903,801 | 9/1975 | Senoski | 102/347 |
| 3,942,441 | 3/1976 | Senoski | 102/347 |
| 4,038,776 | 8/1977 | Filipeli | 46/76 A |
| 4,374,493 | 2/1983 | Hoffing | 102/348 |
| 5,273,477 | 12/1993 | Adams, Jr. | 446/108 |
| 5,507,451 | 4/1996 | Kurnish | 102/351 X |
| 5,575,120 | 11/1996 | Handley | 52/79.1 |

*Primary Examiner*—Peter A. Nelson
*Attorney, Agent, or Firm*—Harry M. Weiss; Jeffrey D. Moy; Harry M. Weiss & Associates, P.C.

[57] ABSTRACT

The present invention is directed to an apparatus and method a flat-side model rocket. In the preferred embodiment, the model rocket is four-sided, and may be constructed by a user from wooden pieces that are pre-cut and pre-engraved with a sealed-$CO_2$ laser. The model rocket of the present invention is compatible with existing model rocket engines, launching apparatuses, and parachute-type recovery apparatuses.

25 Claims, 3 Drawing Sheets

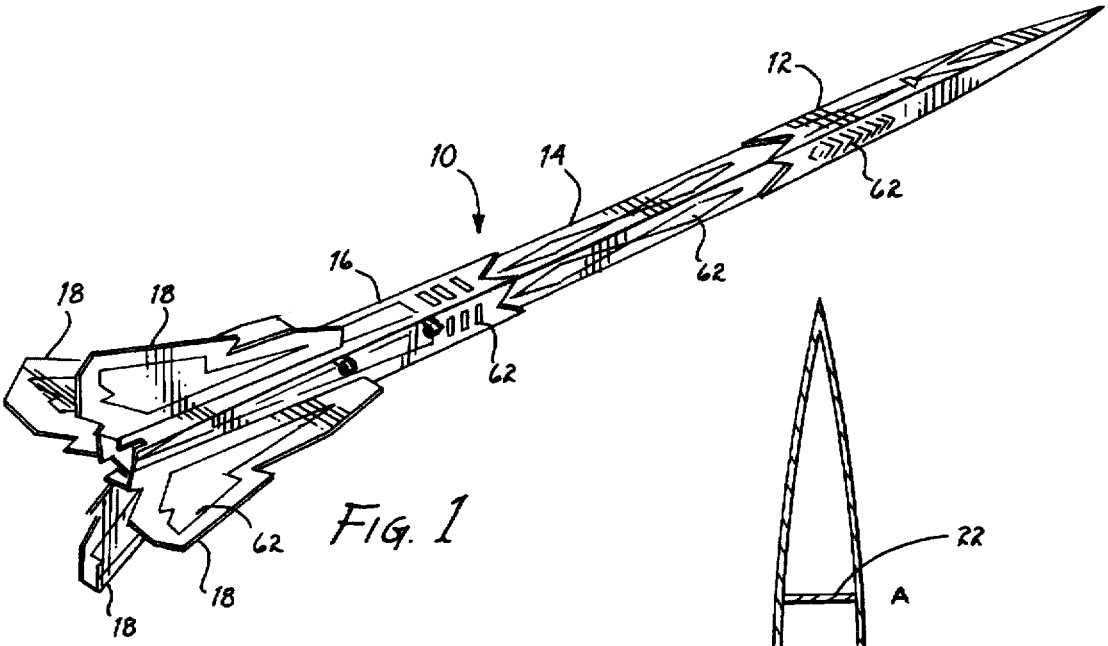
FIG. 1
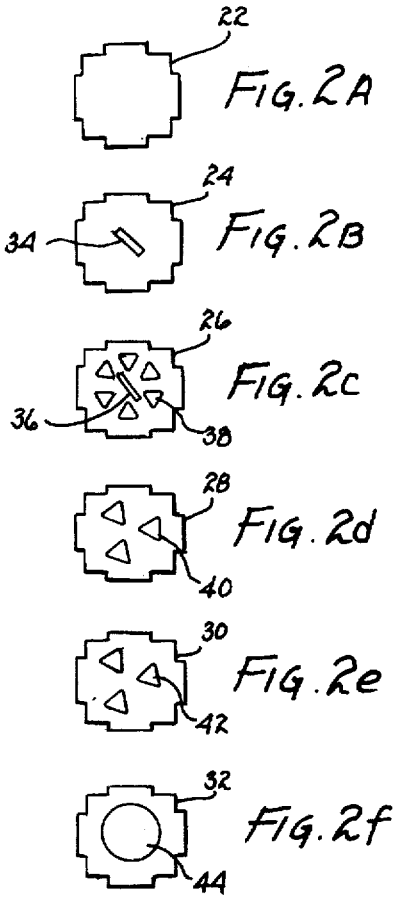
FIG. 2A
FIG. 2B
FIG. 2C
FIG. 2d
FIG. 2e
FIG. 2f
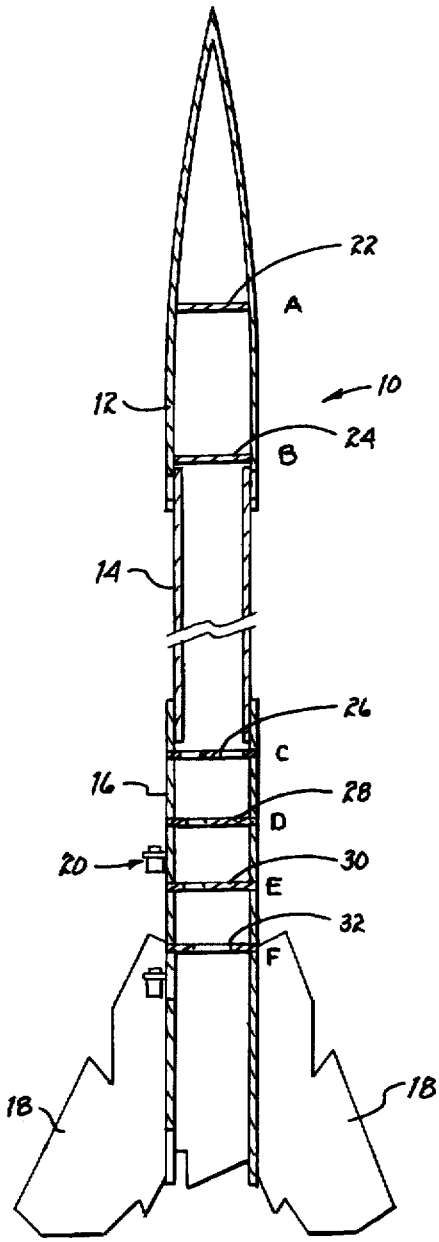
FIG. 2

FLAT-SIDED MODEL ROCKET AND METHOD THEREFOR

BACKGROUND OF THE INVENTION

FIELD OF INVENTION

This invention relates generally to model rockets and, more specifically, to an apparatus and method for a flat-sided model rocket.

BACKGROUND OF THE INVENTION

Model rocketry has long been a popular hobby. Model rockets are relatively simple to construct, decorate, and launch. Model rockets generally consist of a cylindrical rocket body, a top portion or nose cone, a parachute, navigational and stabilizing fins, guides for securing the model rocket to the launching apparatus, and a receptacle at the base of the model rocket to receive a standard model rocket engine. This basic design of the model rocket has remained unchanged for many years.

In general terms, the successful launching and recovery of a model rocket requires several steps. First, the body of the model rocket must be able to receive propelling means—ordinarily an A, B, or C-series model rocket engine that is inserted into the base of the model rocket body. Second, the body of the rocket must have launch guides for securing the model rocket to a launching apparatus during take-off. Third, the body of the rocket must have affixed thereto, generally at the lower end of the body, fins for aligning and stabilizing the rocket during flight. Fourth, the rocket must have a parachute-type recovery system, housed in the body of the model rocket, which permits a parachute to deploy following the rocket's ascent and which allows the rocket to guide gently and slowly back to the ground for re-use. Generally, model rockets have removable top portions—typically called nose cones—which automatically detach from the rocket body during flight to permit the deployment of the parachute at the appropriate time. The nose cone must be secured to the remainder of the rocket body so that it is not lost following detachment and so that it may be recovered with the rest of the rocket. Fifth, the fully-assembled rocket must be connected to a launching apparatus, including an engine igniter, for ignition of the engine and the launching of the model rocket skyward.

For many model rocket hobbyists, actual launching of the model rocket is not a necessary part of their enjoyment. For these individuals, enjoyment comes from constructing and decorating model rockets and perhaps from displaying them. Perhaps because of concern that a valued rocket may be damaged or lost if it is launched, many model rocket hobbyists own rockets that will never experience flight.

Despite its longevity, there are several disadvantages to the conventional model rocket design and, in particular, to the use of a cylindrical rocket body. Proper alignment of fins on a cylindrical rocket body, critical to flight stability and alignment but also important for rocket appearance during display, can be difficult. Moreover, precise decoration of a cylindrical structure—in the form of laser-engraving, painting, or the application of stickers—requires extreme care and effort. This is of particular concern to hobbyists assembling model rockets primarily or exclusively for display purposes. Furthermore, a traditional cylindrical rocket body cannot be shipped through the mail without the use of a box or other large package having significant volume, something that increases the cost of mail shipment of model rockets.

Therefore, a need existed for an apparatus and method for an improved model rocket. The improved model rocket and method must be relatively easy to construct, and must be easier to decorate than existing cylindrical model rockets. In this regard, accurate fin alignment must be made simpler, and decoration of the rocket body—through laser-engraving, painting, and/or the application of stickers—must also be made easier. The improved model rocket and method must also permit the shipping of a model rocket in a substantially flat package having little volume. Finally, the improved model rocket must be capable of being launched and recovered in the manner of traditional model rockets, and must be compatible with existing launching apparatuses and model rocket engines.

SUMMARY OF THE INVENTION

It is an object of the present invention to provide an improved model rocket and method that is compatible with existing launching apparatuses and rocket engines and that may be launched in the manner of traditional model rockets.

It is another object of the present invention to provide an improved model rocket and method that is relatively easy to construct.

It is still another object of the present invention to provide an improved model rocket and method the design of which facilitates alignment of the fins on the rocket body.

It is a further object of the present invention to provide an improved model rocket and method that facilitates decoration of the rocket body through laser engraving and other methods.

It is a still further object of the present invention to provide an improved model rocket and method that permits shipment of the model rocket, prior to construction, in a substantially flat package.

BRIEF DESCRIPTION OF THE PREFERRED EMBODIMENTS

In accordance with one embodiment of the present invention, an improved model rocket apparatus is disclosed. The apparatus is comprised of propelling means for propelling the model rocket; a rocket body coupled to the propelling means and having at least three flat sides, wherein the rocket body comprises a lower body portion, a middle body portion coupled to the lower body portion, an upper body portion coupled to the middle body portion, and flight stabilizing means coupled to the lower body portion for stabilizing the flight of the model rocket; receiving means in a bottom portion of the rocket body for receiving the propelling means for propelling said model rocket; and means coupled to the rocket body for removably connecting the model rocket to a model rocket launching apparatus.

In accordance with another embodiment of the present invention, an improved method for constructing a model rocket is disclosed. The method comprises the steps of: providing propelling means for propelling the model rocket; providing a rocket body coupled to the propelling means and having at least three flat sides, wherein the step of providing a rocket body further comprises the steps of providing a lower body portion, a middle body portion coupled to the lower body portion, an upper body portion coupled to the middle body portion, and flight stabilizing means coupled to the lower body portion for stabilizing the flight of the model rocket; providing receiving means in a bottom portion of the rocket body for receiving the propelling means for propelling said model rocket; and providing means coupled to the rocket body for removably connecting the model rocket to a model rocket launching apparatus.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 1 is a perspective view of the model rocket of the present invention.

FIG. 2 is a cross-sectional view of the model rocket of the present invention in the upright position.

FIG. 2*a* is a top view of a first cross member located in a top portion of the rocket body of the model rocket of the present invention.

FIG. 2*b* is a top view of a second cross member located in a top portion of the rocket body of the model rocket of the present invention.

FIG. 2*c* is a top view of a first cross member located in a bottom portion of the rocket body of the model rocket of the present invention.

FIG. 2*d* is a top view of a second cross member located in a bottom portion of the rocket body of the model rocket of the present invention.

FIG. 2*e* is a top view of a third cross member located in a bottom portion of the rocket body of the model rocket of the present invention.

FIG. 2*f* is a top view of a fourth cross member located in a bottom portion of the rocket body of the model rocket of the present invention.

DETAILED DESCRIPTION OF THE PREFERRED EMBODIMENTS

Figures 4, 4A, 4B, 4C:
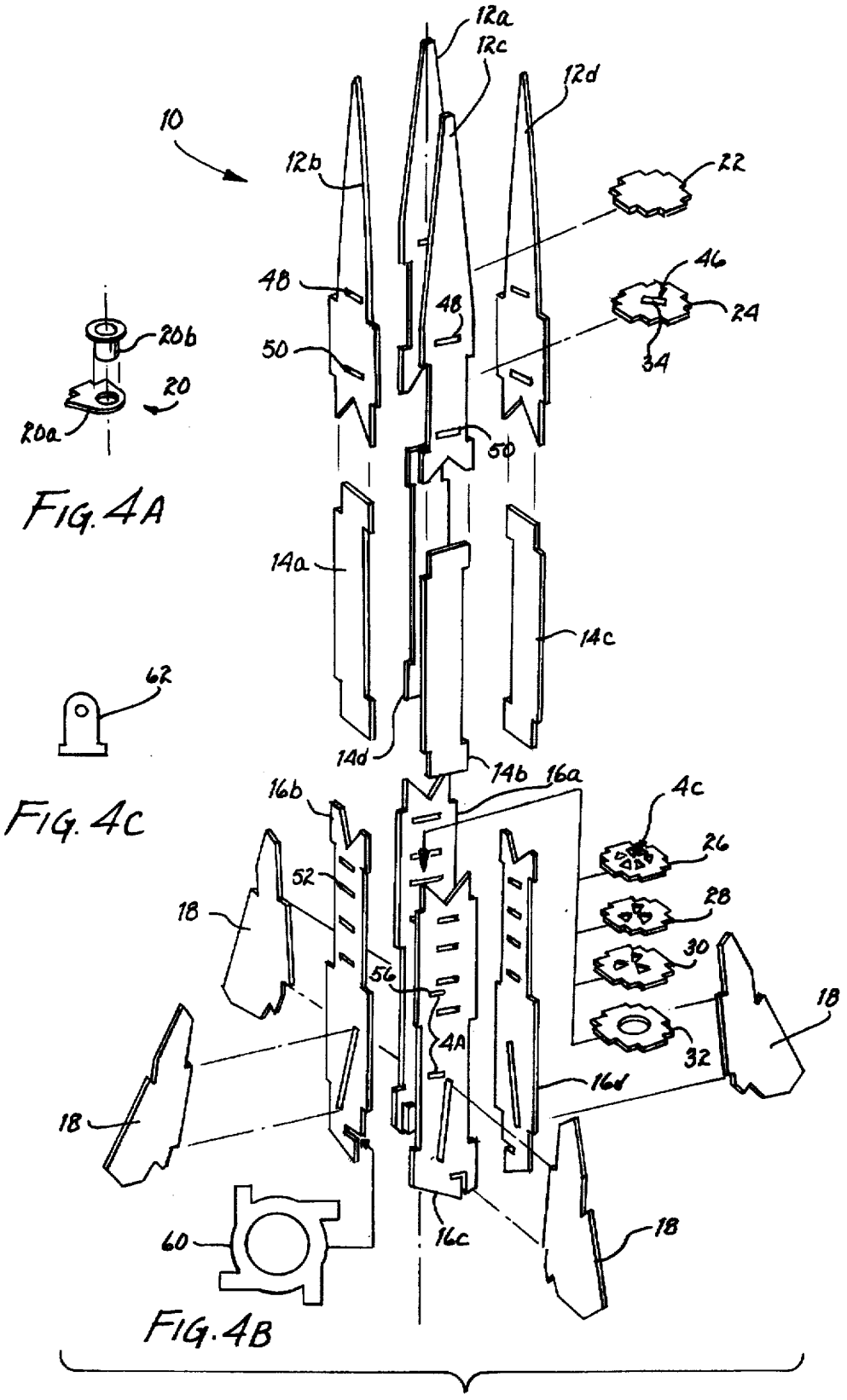
FIG. 4 is an exploded view of the model rocket of the present invention.
FIG. 4*a* is a perspective view of a launch guide of the present invention.
FIG. 4*b* is a top view of the engine lock of the present invention.
FIG. 4*c* is a top view of a lug of the present invention.

Reference number 10 refers generally to the model rocket of this invention. Referring now to FIG. 1, the body of the model rocket 10 is four-sided and is comprised of three sections—a top portion or nose cone 12, a middle portion 14, and a bottom portion 16. Attached to the bottom portion 16 are four fins 18, one fin on each of the four sides of the bottom portion 16. The fins 18 extend outward at a substantially 90 degree angle from each of the four sides of the bottom portion 16, and slant across the four sides of the bottom portion 16. Also attached to the bottom portion 16 are launch guides 20, comprising lugs 20*a* and eyelets 20*b* (see FIG. 4*a*). At the end of the top portion 12 that adjoins the middle portion 14, each of the four sides of the top portion 12 has a triangular-shaped portion cut-away therefrom for decorative purposes. In like fashion, at the end of the bottom portion 16 that adjoins the middle portion 14, each of the four sides of the bottom portion 16 has a triangular-shaped portion cut-away therefrom. As shown in FIG. 1, on the end of the top portion 12 that does not adjoin the middle portion 14, the sides of the top portion 12 narrow and angle inward so as to form a point.

Referring to FIGS. 2*a*–2*f*, shown are six cross members 22, 24, 26, 28, 30, and 32. Each of the cross members 22, 24, 26, 28, 30, and 32 is substantially square, with tab ends extending from each of the four sides thereof. Cross members 22 and 24 are located in the top portion 12 of the model rocket 10 (see FIGS. 2 and 4). Cross member 24 has a narrow rectangular-shaped opening 34 in the center thereof, substantially along the diagonal between two of the corners of the cross member 24, for receiving a lug 62 (see FIG. 4C). Cross members 26, 28, 30, and 32 are located in the bottom portion 16 of the model rocket 10 (see FIGS. 2 and 4). Cross member 26 has in the same manner as cross member 24 a narrow rectangular-shaped opening 36 in the center thereof, substantially along the diagonal between two of the corners of the cross member 26, for receiving a lug 62 (see FIG. 4C). Cross member 26 has six triangular-shaped openings 38 in the center thereof, which openings 38 are positioned an approximately equal distance from each other and with a side of each of the openings 38 substantially in a circle around the rectangular-shaped opening 36. Cross member 28 has three triangular-shaped openings 40 in the center thereof, which openings 40 are positioned an approximately equal distance from each other and with a side of each of the openings 40 substantially in a circle around the center of the cross member 28. Cross member 30 has three triangular-shaped openings 42 in the center thereof, which openings 42 are positioned an approximately equal distance from each other and with a side of each of the openings 42 substantially in a circle around the center of the cross member 30. Cross member 32 has a round opening 44 in the center thereof, for receiving the non-igniting end of a model rocket engine.

Figure 3:
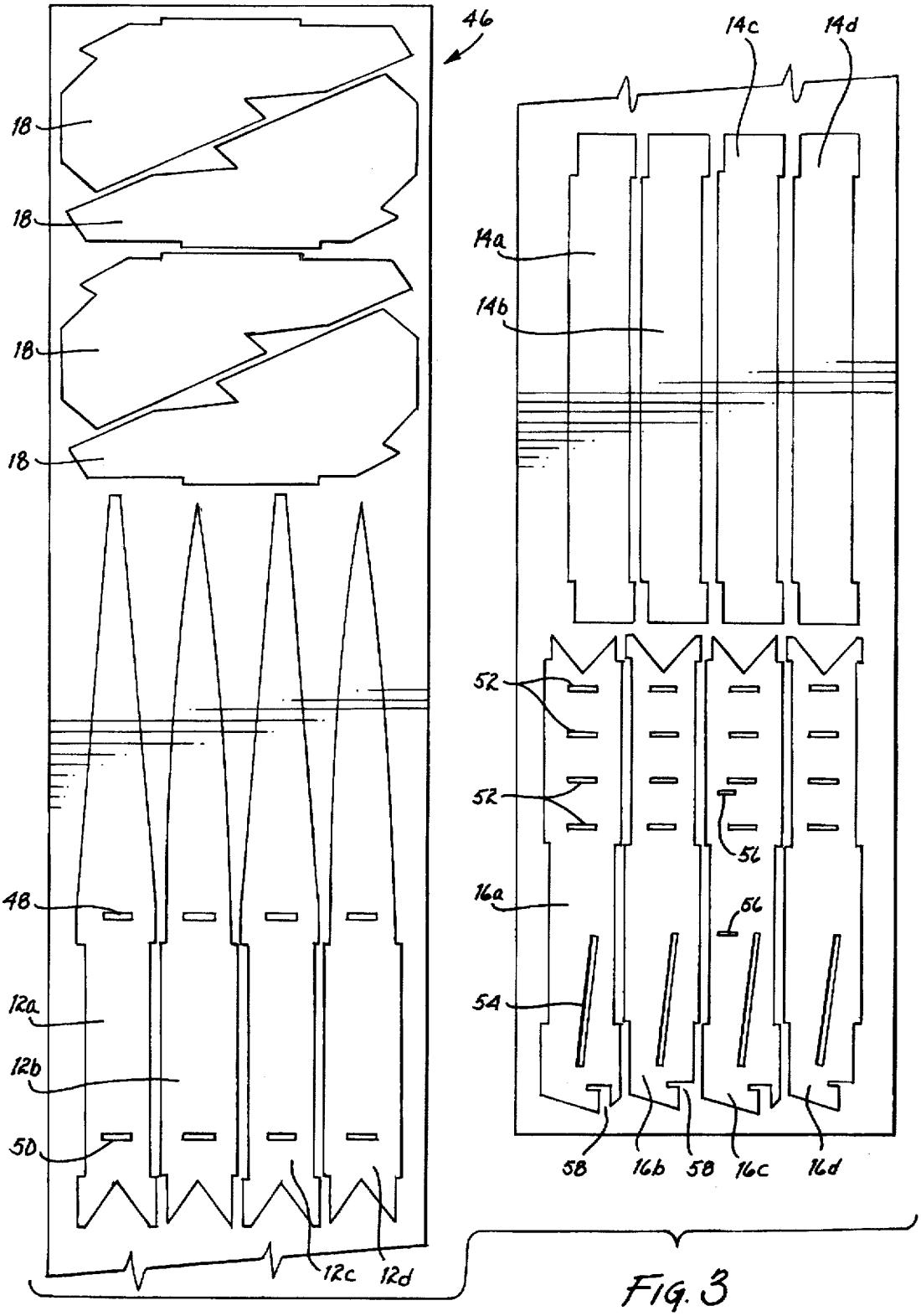
FIG. 3 is a top view of the rocket body of the model rocket of the present invention, prior to construction.

Referring to FIG. 3, a top view of the body of the model rocket 10, prior to construction, is shown arranged on wooden sheet 46. As shown in FIG. 3, the four sides of the top portion 12 (sides 12*a*, 12*b*, 12*c*, and 12*d*), the middle portion 14 (sides 14*a*, 14*b*, 14*c*, and 14*d*), and the bottom portion 16 (sides 16*a*, 16*b*, 16*c*, and 16*d*) are cut from a thin sheet of wood, preferably with a sealed-$CO_2$ laser, in such fashion that the sides are not completely severed from the wooden sheet 46, so that these portions of the model rocket 10 can be shipped in one piece and in a flat package to a user, and then popped out by the user for construction. The wooden sheet 46 also includes four fins 18, that are cut from the wooden sheet 46 in the same manners as the sides of the top portion 12, middle portion 14, and bottom portion 16.

As shown in FIG. 3, the four sides 12*a*, 12*b*, 12*c*, and 12*d* each comprise a substantially rectangular bottom portion and a substantially triangular top portion. At substantially the confluence of the rectangular and triangular portions thereof, each of the four sides comprising the top portion 12 has thereon a narrow rectangular-shaped opening 48, for receiving a tabbed end of cross member 22 (see FIGS. 2 and 4). Each of the four sides comprising the top portion 12 also has thereon, near the bottom of the rectangular portion thereof, a second rectangular opening 50 for receiving a tabbed end of cross member 24 (see FIGS. 2 and 4), which rectangular openings 50 are parallel to the rectangular openings 48. Sides 12*a* and 12*c* each have portions cut away along the sides of the rectangular portions thereof, so as to mate with corresponding tabs on sides 12*b* and 12*d*. The triangular portions of sides 12*a*, 12*b*, 12*c*, and 12*d* end substantially in a point.

Still referring to FIG. 3, four sides 14*a*, 14*b*, 14*c*, and 14*d* are shown, comprising the middle portion 14 of the model rocket 10. Each of these sides is substantially rectangular, with a tab on one long side and a cut-away portion of corresponding size on the second long side. During assembly, the tabbed and cut-away portions are interlocked, so that, for example, the tabbed portion of side 14*a* interlocks with the cut-away portion of side 14b, while the tabbed portion of side 14b interlocks with the cut-away portion of side 14c.

FIG. 3 also shows four sides 16a, 16b, 16c, and 16d, comprising the bottom portion 16 of the model rocket 10. The four sides of the bottom portion 16 are substantially rectangular in shape, and comprise an upper and lower portion. The upper portion of each of the four sides of the bottom portion 16 contains four parallel, narrow, rectangular openings 52, for receiving tabbed ends of cross members 26, 28, 30, and 32 (see FIGS. 2 and 4). The lower portion of each of the four sides of the bottom portion 16 contains a narrow, rectangular opening 54 in substantially a diagonal orientation for receiving a fin 18 (see FIG. 2). Side 16c contains two additional narrow rectangular openings for receiving lugs 20a (see FIGS. 2 and 4). The sides of the upper portions of sides 16a and 16c are tabbed, and the bottom portions of sides 16a and 16c have cut away portions of substantially the same size. Sides 16b and 16d have corresponding, reversed tabbed and cut away portions, with tabs on the bottom portions and cut away portions on the top portions of sides 16b and 16d. The tabs and cut away portions on the four sides comprising the bottom portion 16 are interlocked during construction.

At the base of each of the sides 16a, 16b, 16c, and 16d, there is a substantially 1-shaped channel 58. After a rocket engine (not shown) is inserted into the bottom portion 16 of the assembled model rocket 10, the rocket engine is secured in position with the insertion into the 1-shaped channels 58 of the tabbed portions of a TEFLON®-coated, substantially round engine lock 60 (see FIG. 4B).

Still referring to FIG. 3, each of the fins 18 is substantially in the shape of a right-angled triangle, with portions cut away from each of the three sides thereof for design purposes. Each of the fins 18 is connected to one of the four sides 16a, 16b, 16c, or 16d by the insertion of a tabbed portion from one of the sides of the fin 18 into an opening 54 (see FIGS. 2 and 4).

Referring again to FIGS. 2a–2f, the cross members 22, 24, 26, 28, 30, and 32—like the portions of the model rocket 10 shown in FIG. 3—are cut from a thin sheet of wood with a sealed-$CO_2$ laser. The rectangular-shaped openings 34 and 36, the triangular-shaped openings 40 and 42, and the round opening 44 are also cut into the corresponding cross member with a laser. With respect to the triangular-shaped openings 40 and 42 and the round opening 44, these are cut into the corresponding cross member with the laser in such fashion that the wood occupying the opening is not completely severed from the cross member, so that the user can during construction pop out the cut out portions to reveal the openings.

The sides of the top portion 12, the middle portion 14, and the bottom portion 16, and the fins 18, may be decorated with any variety of decorations 62 (see FIG. 1), which can be applied using a sealed $CO_2$ laser. Portions of the model rocket 10 may also be decorated by painting the rocket and/or by applying stickers thereto.

Construction of the Model Rocket

As is common in the model rocket area, the model rocket 10 of the present invention is designed so that it may be constructed by a model rocket hobbyist. Thus, a user purchasing the model rocket 10 for construction will receive a sheet of wood 46, shown in FIG. 3, with the four sides of the top portion 12, middle portion 14 and bottom portion 16, and the four fins 18. The contents of the sheet of wood 46 are cut into the sheet of wood 46 with a laser so that the pieces are not entirely severed from the sheet of wood 46, but may be easily popped out by a user for construction. The user of the model rocket 10 will also receive cross members 22, 24, 26, 28, 30, and 32; at least two lugs 20a and two eyelets 20b; at least two lugs 62; a shock cord for coupling the top portion 12 and the bottom portion 16 (not shown); and a parachute recovery apparatus (not shown).

A user assembling the model rocket 10 will first glue a lug 62 into the opening 34 in the center of cross member 24 and a lug 62 into the opening 36 in the center of cross member 26, in both instances so that the lug extends entirely through the openings and the bottom portions of the lugs are flush with the cross members. For added strength, it is preferable to first glue two lugs 62 face to face before gluing the lugs 62 into position in the openings 34 and 36. One end of a shock cord, an elastic cord that is standard in the model rocket industry, may be secured to the opening in the lug 62 that has been coupled to the cross member 26.

Next, a user will attach the fins 18 to the four sides 16a, 16b, 16c, and 16d of bottom portion 16, by gluing the tabbed portions of the fins 18 into the openings 54. The user will then take cross members 26, 28, 30, and 32, remove any remaining cut outs in openings 38, 40, 42, and 44, and will glue these cross members into one side of the bottom portion 16 in order, with cross member 26 occupying the highest position and cross member 32 occupying the lowest position. Next, the user will take two eyelets 20b, glue them into two lugs 20a, and glue the assembled apparatus into the openings 56 on side 16c. For added strength, it is preferable to first glue two lugs 20a face to face before inserting the eyelets 20b and gluing the apparatus into position in the openings 56.

Taking the side of the bottom portion 16 with the cross members attached, the user then glues that side to the two sides with the opposite orientation of tabs and openings—for example, if the cross members have been attached to side 16a, side 16a should then be glued to sides 16b and 16d. The remaining side of the bottom portion 16 is then glued to the three assembled sides, so as to complete the construction of the bottom portion 16. As each additional side is added, the tabs of cross members 26, 28, 30, and 32 are glued into the openings 52 in the additional side.

After assembly of the bottom portion 16 is completed, the user then assembles the middle portion 14. To accomplish this, the user glues to the interlocking surfaces of sides 14a, 14b, 14c, and 14d, and attaches each side to the two sides with corresponding tabs and openings. The assembled middle portion 14 is glued into the bottom portion 16. During this assembly step, the unattached end of the shock cord (not shown), is threaded through the middle portion 14 and attached to the lug 62 attached to cross member 24. Also attached to the lug 62 attached to the cross member 24 is a parachute assembly (not shown), of the type commonly used in the model rocket industry. The parachute canopy is housed in the middle portion 14 during the launching of the model rocket 10.

The user next takes one of the four sides comprising the top portion 12, and inserts into the opening 48 thereon a tabbed portion of cross member 22, and into the opening 50 thereon a tabbed portion of cross member 24. Taking the side of the top portion 12 with the cross members attached, the user glues that side to the two sides with the opposite orientation of tabs and openings—for example, if the cross members have been attached to side 12a, side 12a should then be glued to sides 12b and 12d. (As each additional side is added, the tabs of cross members 22 and 24 are glued into the openings 48 and 50, respectively, in the additional side.) The remaining side of the top portion 12 is then glued to the three assembled sides, and the pointed tips of the sides 12*a*, 12*b*, 12*c*, and 12*d* are secured together so as to form a point and to complete the construction of the top portion 12.

The assembled model rocket 10, which preferably has laser engraved designs 62 of any variety on one or more of the portions thereof, may be painted by the user or may have stickers applied thereto.

To launch the model rocket 10, the user must insert a model rocket engine (not shown) into the open portion of bottom portion 16, and secure the rocket engine into position with a round engine lock 60, the tabbed ends of which engine lock 60 are inserted into the slotted portions of the 1-shaped channels 58. Prior to launching, the top portion 12 must be inserted onto the middle portion 14, with the parachute assembly (not shown) housed in the middle portion 14. The model rocket 10 is then placed onto a launching apparatus (not shown), with the launching rod of the launching apparatus being inserted through the eyelets 20*b*. The model rocket 10 may then be launched using an igniter of the type common in the industry (not shown).

While the invention has been particularly shown and described with reference to preferred embodiments thereof, it will be understood by those skilled in the art that the foregoing and other changes in form and details may be made therein without departing from the spirit and scope of the invention. In this regard, the number of flat sides may be increased from four or may be reduced to three while still preserving many of the advantages of the present invention.

I claim:

1. An aerial model rocket comprising, in combination:

an aerial model rocket body having at least four flat sides;

propelling means for propelling said aerial model rocket in a substantially skyward direction;

receiving means in a bottom portion of said aerial model rocket body for receiving said propelling means for propelling said aerial model rocket; and means coupled to said serial model rocket body for removably connecting said serial model rocket to an aerial model rocket launching apparatus.

2. An aerial model rocket in accordance with claim 1 further comprising recovery means coupled to said aerial model rocket body for facilitating the recovery of said aerial model rocket following launching and flight thereof.

3. An aerial model rocket in accordance with claim 1 wherein said propelling means comprises a substantially cylindrical model rocket engine.

4. An aerial model rocket in accordance with claim 1 wherein said rocket body comprises, in combination:

a lower body portion;

a middle body portion coupled to said lower body portion;

an upper body portion coupled to said middle body portion; and flight stabilizing means coupled to said lower body portion for stabilizing the flight of said model rocket.

5. An aerial model rocket in accordance with claim 4 wherein said flight stabilizing means comprises at least one fin coupled to said lower body portion.

6. An aerial model rocket in accordance with claim 5 wherein said bottom portion of said rocket body comprises a plurality of cross members.

7. An aerial model rocket in accordance with claim 6 wherein at least one of said cross members is coupled to a first end of connecting means connecting said bottom portion to an upper portion of said rocket body.

8. An aerial model rocket in accordance with claim 7 wherein said upper portion comprises cross members coupled to a second end of said connecting means connecting said upper portion to said bottom portion.

9. An aerial model rocket in accordance with claim 4 wherein said lower body portion comprises releasably attached retaining means for releasably retaining said propelling means in said lower body portion of said rocket body.

10. An aerial model rocket in accordance with claim 9 wherein said releasably attached retaining means are comprised of TEFLON®.

11. An aerial model rocket in accordance with claim 1 wherein said flat sides are comprised of wood.

12. A method for constructing an aerial model rocket comprising the steps of:

providing an aerial model rocket body having at least four flat sides;

providing propelling means for propelling said aerial model rocket in a substantially skyward direction;

providing receiving means in a bottom portion of said aerial model rocket body for receiving said propelling means for propelling said aerial model rocket;

providing means coupled to said aerial model rocket body for removably connecting said aerial model rocket to an aerial model rocket launching apparatus; and providing recovery means coupled to said aerial model rocket body for facilitating the recovery of said aerial model rocket following launching and flight thereof.

13. The method of claim 12 wherein the step of providing propelling means further comprises the step of providing a substantially cylindrical model rocket engine.

14. The method of claim 12 wherein the step of providing said rocket body further comprises the steps of:

providing a lower body portion;

providing a middle body portion coupled to said lower body portion;

providing an upper body portion coupled to said middle body portion; and providing flight stabilizing means coupled to said lower body portion for stabilizing the flight of said model rocket.

15. The method of claim 14 wherein the step of providing said flight stabilizing means further comprises the step of providing at least one fin coupled to said lower body portion.

16. The method of claim 12 wherein the step of providing said recovery means further comprises the steps of:

providing a parachute canopy; and providing connecting means for connecting said parachute canopy to said bottom portion of said rocket body.

17. The method of claim 14 wherein the step of providing said bottom portion of said rocket body further comprises the step of providing a plurality of cross members and connecting means coupled to said cross members for connecting said parachute canopy to said bottom portion.

18. The method of claim 17 wherein the step of providing a plurality of cross members further comprises the step of coupling at least one of said cross members to a first end of connecting means connecting said bottom portion to an upper portion of said rocket body.

19. The method of claim 18 wherein the step of providing said upper body portion further comprises the step of providing a plurality of cross members coupled to a second end of said connecting means connecting said upper portion to said bottom portion.

20. The method of claim 19 further comprising the step of housing said parachute canopy in a middle portion of said rocket body located between said bottom portion and said upper portion.

21. The method of claim 14 wherein the step of providing said lower body portion further comprises the step of providing releasably attached retaining means for releasably retaining said propelling means in said lower body portion of said rocket body.

22. The method of claim 21 further comprising the step of providing said releasably attached retaining means comprised of TEFLON®.

23. The method of claim 14 further comprising the step of providing said flat sides comprised of wood.

24. A method for constructing a model rocket comprising the steps of:

providing propelling means for propelling said model rocket;

providing a rocket body having four flat sides;

said four flat sides being comprised of wood;

the step of providing said four flat sides further comprises the step of laser shaping said four flat sides;

said step of providing said rocket body further comprises the steps of:

providing a lower body portion;

providing a middle body portion coupled to said lower body portion;

providing an upper body portion coupled to said middle body portion; and providing flight stabilizing means coupled to said lower body portion for stabilizing the flight of said model rocket;

providing receiving means in a bottom portion of said lower body portion of said rocket body for receiving said propelling means for propelling said model rocket;

providing means coupled to said rocket body for removably connecting said model rocket to a model rocket launching apparatus; and providing recovery means for facilitating the recovery of said model rocket following launching and flight thereof.

25. The method of claim 24 wherein the step of providing said four flat sides further comprises the step of laser engraving at least one of said four flat sides.

* * * * *